US006967447B2

(12) United States Patent
Lim et al.

(10) Patent No.: US 6,967,447 B2
(45) Date of Patent: Nov. 22, 2005

(54) PRE-CONFIGURED LIGHT MODULES

(75) Inventors: Kevin Len Li Lim, Perak (MY); Joon Chok Lee, Sarawak (MY); Rizal Bin Jaffar, Melaka (MY)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/740,949

(22) Filed: Dec. 18, 2003

(65) Prior Publication Data

US 2005/0134202 A1 Jun. 23, 2005

(51) Int. Cl.[7] ..... G05F 1/00; F21S 4/00
(52) U.S. Cl. ..... 315/291; 362/800
(58) Field of Search ..... 315/291, 293, 315/300, 307, 244, 304; 362/800

(56) References Cited

U.S. PATENT DOCUMENTS

| | | | | |
|---|---|---|---|---|
| 6,177,376 | B1 * | 1/2001 | Fritze et al. | 502/110 |
| 6,777,891 | B2 * | 8/2004 | Lys et al. | 315/291 |
| 6,781,329 | B2 * | 8/2004 | Mueller et al. | 315/297 |
| 6,793,374 | B2 * | 9/2004 | Begemann | 362/294 |
| 6,801,003 | B2 * | 10/2004 | Schanberger et al. | 315/291 |
| 6,806,659 | B1 * | 10/2004 | Mueller et al. | 315/295 |
| 2002/0071279 | A1 * | 6/2002 | Katogi et al. | 362/317 |
| 2003/0111533 | A1 | 6/2003 | Chang | 235/454 |

FOREIGN PATENT DOCUMENTS

| | | |
|---|---|---|
| GB | 2 349 942 A | 11/2000 |
| GB | 2 402 998 A | 12/2004 |
| JP | 2000 315070 A | 11/2000 |

* cited by examiner

*Primary Examiner*—Don Wong
*Assistant Examiner*—Minh Dieu A

(57) ABSTRACT

The present invention includes a light source having N light generators, a receiver, and an interface circuit. Each light generator emitting light of a different wavelength, the intensity of light generated by the $k^{th}$ generator is determined by a signal $I_k$ coupled to that light generator. The receiver receives a color coordinate that includes N color components, $C_k$, for k=1 to N, wherein N is greater than 1. The interface circuit generates the $I_k$ for k=1 to N from the received color components and a plurality of calibration parameters. The calibration parameters depend on manufacturing variations in the light generators. The calibration parameters have values chosen such that a light signal generated by combining the light emitted from each of the light generators is less dependent on the manufacturing variations in the light generators than a light signal generated when $I_k$ is proportional to $C_k$ for k=1 to N.

12 Claims, 3 Drawing Sheets

PRE-CONFIGURED LIGHT MODULES

FIELD OF THE INVENTION

The present invention relates to light sources.

BACKGROUND OF THE INVENTION

Light emitting diodes(LEDs) are attractive candidates for replacing conventional light sources such as incandescent lamps and fluorescent light sources. The LEDs have higher light conversion efficiencies and longer lifetimes. Unfortunately, an LED produces light in a relatively narrow spectral band. Hence, to produce a light source having an arbitrary color, a compound light source having multiple LEDs is typically utilized or part of the light from a single LED must be converted to light of a second wavelength, which is mixed with the light from the original LED. For example, an LED-based white light source that provides an emission that is perceived as white by a human observer can be constructed by combining light from arrays of red, blue, and green emitting LEDs that are generating the correct intensity of light at each color. Similarly, light of other spectral emissions can be produced from the same arrays by varying the intensity of the red, blue, and green LED outputs to produce the desired color output. The intensity of light from each array can be varied by varying the magnitude of the current through the LED or by switching the LEDs on and off with a duty cycle that determines the average intensity of light generated by the LEDs.

A light source designer typically knows the desired output color for a light source in terms of standardized red, blue, and green light intensities. In principle, a light source constructed from red, blue, and green LEDs can be utilized provided the intensities of the light from the individual colors is adjusted to match the required red, blue, and green intensities. Unfortunately, the LED fabrication process provides LEDs having emissions and efficiencies that vary somewhat from one LED to another. If the designer constructs an LED lighting system by assuming that the LEDs are all the same, the variations lead to color shifts in the perceived spectrum of the light. Such variations are often unacceptable. One solution to this problem involves selecting the LEDs such that the selected LEDs have precisely the correct emission efficiency and spectrum. Unfortunately, this solution reduces the production yield and cost increases.

In principle, each light source can be adjusted to provide the desired output spectrum. Such a process involves determining the current to be applied to each of the colored arrays of LEDs in each light source by varying the currents and examining the light source output with a standardized camera. An LED light source system with spectral feedback ("LED lighting feedback system") can be constructed using the above described principle. A standardized camera continually sends measurement information to the light source controller, which adjusts the driving current to the LEDs. A standardized camera may be one that is configured to respond closely to the CIE color matching function (CMF). Such a camera will produce measurements that correspond to the CIE standard color scheme. Cameras that correspond to other standards may also be used. These standardized cameras are usually expensive because their responses are tuned to correspond to the standard spectral responses. The CIE color matching function is an example of a standard spectral response. A less expensive alternative is to utilize a CMOS tri-color sensor that is sensitive to the red, green and blue region of the visible spectrum. These sensors are commercially available and have constructions that are similar to CMOS cameras used in PDAs and mobile phones. These sensors typically do not conform to a standard color scheme. One problem with using such sensors is that a calibration procedure is required to map the spectral responses of the sensor to the LED light source spectral output. This requires the manufacturer of the LED lighting feedback system to install and maintain this type of calibration equipment on the manufacturer's production line as well as setting the calibration values for each light source produced. This increases the capital investment needed to establish the production line. If the manufacturer of the LED lighting feedback system is supplied with compound light sources that emit light of known CIE coordinates, then the calibration procedure, although still necessary, becomes less expensive and simpler because the calibration values for each compound light source is known without measurement.

SUMMARY OF THE INVENTION

The present invention includes a light source having N light generators, a receiver, and an interface circuit. Each light generator emitting light of a different wavelength, the intensity of light generated by the $k^{th}$ generator being determined by a signal $I_k$ coupled to that light generator. The receiver receives a color coordinate that includes N color components, $C_k$, for k=1 to N, wherein N is greater than 1. The interface circuit generates the $I_k$ for k=1 to N from the received color components and a plurality of calibration parameters. The calibration parameters depend on manufacturing variations in the light generators. The calibration parameters have values chosen such that a light signal generated by combining the light emitted from each of the light generators is less dependent on the manufacturing variations in the light generators than a light signal generated when $I_k$ is proportional to $C_k$ for k=1 to N. In one embodiment, one of the $I_k$ is proportional to a weighted sum of the $C_k$ values, the weighted sum utilizing weight parameters that depend on the calibration parameters. In another embodiment, each of the light generators includes an LED. In a further embodiment, N=3 and one of the light generators generates light in the red region of the optical spectrum, another of the light generators generates light in the blue region of the optical spectrum, and the remaining light generator generates light in the green region of the light spectrum. In a still further embodiment, the color components correspond to the CIE color standard, and the calibration parameters are chosen such that the light signal generated by combining the light emitted from each of the light generators is characterized by color components in the CIE color standard of $C'_k$ when received color components have values in which $C_k=C'_k$, for k=1 to 3.

DETAILED DESCRIPTION OF THE PREFERRED EMBODIMENTS OF THE INVENTION

Figure 1:
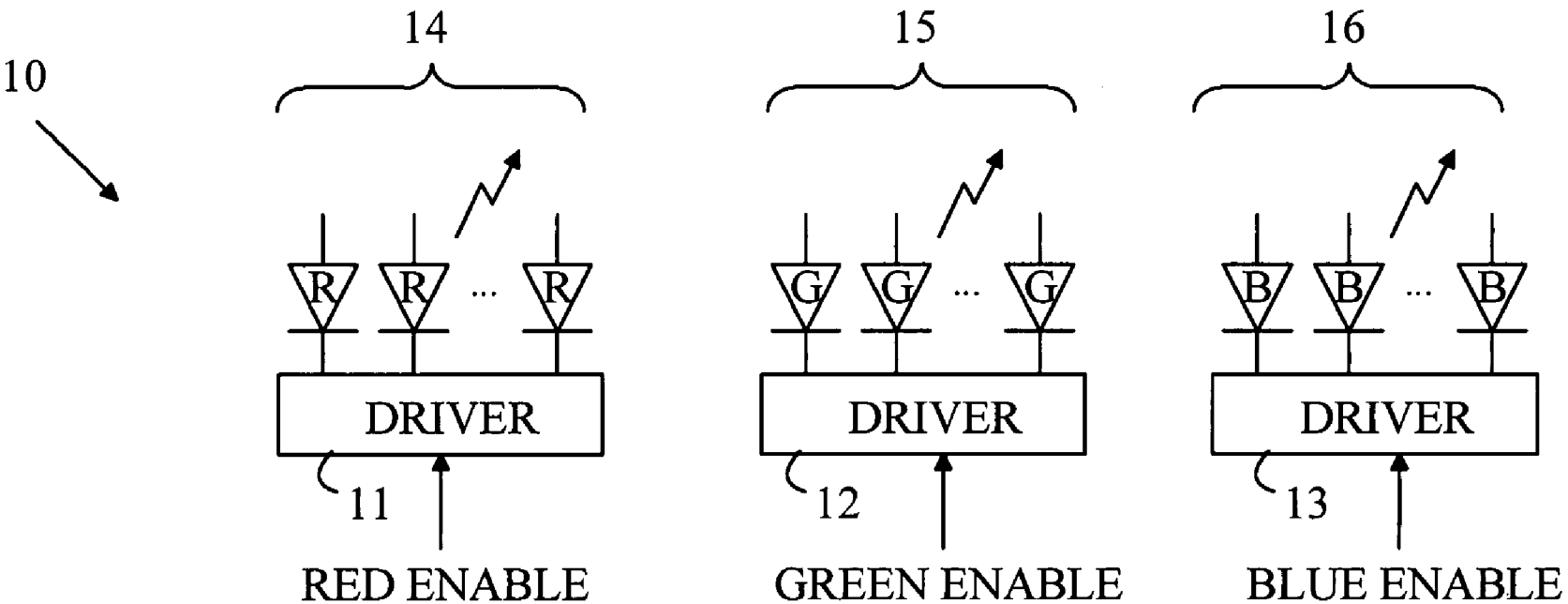
FIGURE 1 (PRIOR ART)
FIG. 1 is a prior art compound light source 10.

The present invention provides a method for constructing a pre-configured compound light source for use in a lighting system that employs spectral feedback to control the emitted light, such that calibration of the sensor can be performed without the need for expensive test equipment. The manner in which the present invention provides its advantages can be more easily understood with reference to FIG. 1, which illustrates a prior art compound light source 10. Light source 10 is constructed from three arrays of LEDs shown at 14–16. Arrays 14–16 emit light in the red, green, and blue spectral ranges, respectively. Arrays of LEDs of each color are used instead of a single LED to increase the light output of the light source. The intensity of light generated by each array is determined by the current flowing through the LEDs in that array or by the duty cycle of a pulsing signal that is applied to each LED. For the purposes of this discussion, it will be assumed that the intensity is varied by changing the current through the LEDs. However, the present invention can also be used in systems in which the LEDs are pulsed on and off in a manner in which the ratio of the "on" time to the "off" time is controlled to provide the desired light output. This current is set by drivers 11–13 in response to red, green, and blue enable signals that are input to the drivers. The enable signals can be simple logic signals that turn on the corresponding arrays with a predetermined current that is set in the driver circuits. Alternatively, the enable signals can be multivalued signals that set the actual current levels through the corresponding array.

As noted above, manufacturing variations occur in the LEDs of each array. As a result, the current-to-light output function characteristic of each array varies from array to array. In addition, there is a spectral variation from array to array in the manufacturing process that also can lead to color shifts in the light generated by light source 10.

Figure 2:
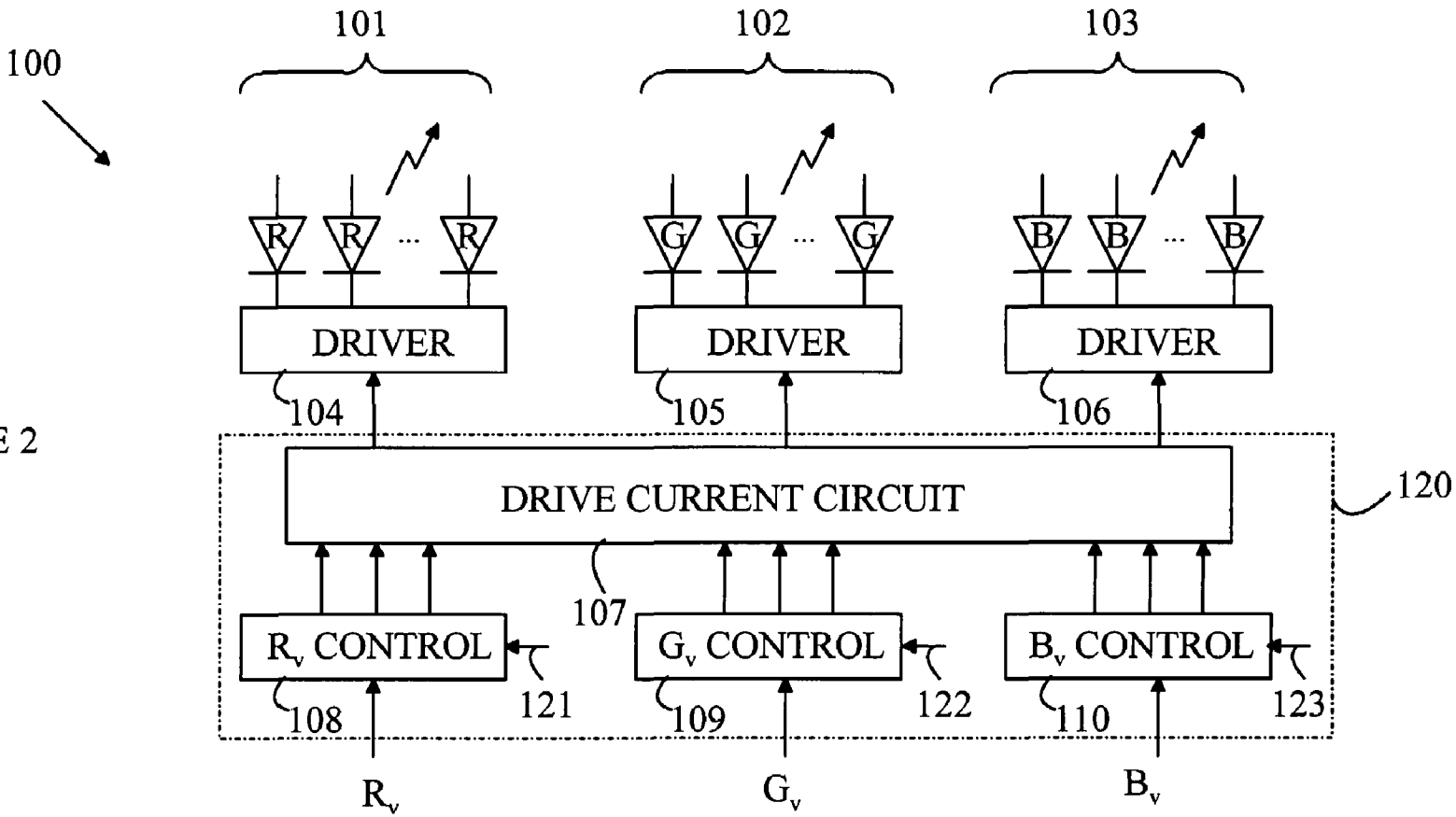
FIG. 2 is a block diagram of a compound light source 100 according to one embodiment of the present invention.

The manner in which the present invention overcomes these problems is illustrated in FIG. 2, which is a block diagram of a compound light source 100 according to one embodiment of the present invention. Light source 100 is constructed from the three arrays of LEDs shown at 101–103. Arrays 101–103 generate light that is nominally red, green, and blue respectively. The intensity of light generated by each array is determined by the current flowing through the LEDs of that array, which, in turn is set by a driver attached to the array. The drivers corresponding to arrays 101–103 are shown at 104–106, respectively.

As noted above, the ideal light source accepts a color specified as three values in a standard color specification scheme such as the CIE scheme and generates light having the specified CIE color coordinate. That is, if the output light is measured in a spectrometer that outputs three values in the standardized color scheme, the output of the spectrometer will match the input values provided to the light source. The present invention provides a control scheme that reduces the variations among arrays, and in addition, provides such a standardized color specification scheme. The present invention provides an interface circuit 120 that accepts red, blue, and green intensity values and provides the appropriate currents to each of the arrays. The currents are determined by adjusting 9 weight factors in a manner discussed below. Ideally, when the correct weight factors are used, the light source will generate a CIE color coordinate specified by the input values independent of the variations in LED light conversion efficiency from LED to LED and any variations in the spectra from LED to LED of the same color. The weight factors are determined for each light source and stored in the light source. Hence, from the point of view of the circuit designer utilizing the light source, each light source behaves as an ideal light source that generates the same CIE color coordinate as measured by the standard spectrometer when the same values of the red, green, and blue intensities are input to the light source. Furthermore, the generated spectrum conforms to a standard spectrum scheme. Since all of the calibration and correction circuitry is contained in the light source, the manufacturer is relieved of the tasks associated with providing calibration circuitry and adjusting the calibration of each light source prior to using the light source in the manufacturer's device. That is, the designer only needs to know the desired color output in terms of the standardized RGB color coordinates.

In the embodiment shown in FIG. 2, each of the standardized color values is received by a corresponding control circuit. The control circuits for the standardized input values corresponding to red, green, and blue are shown at 108–110, respectively. To simplify the following discussion, the inputs to the control circuits will be written as a triplet of the form $(R_v, G_v, B_v)$. The goal of interface 120 is to provide current values to the LED drivers such that the spectrum generated by $(R_v, G_v, B_v)$ is the same as that specified in the standard color scheme, and the intensity of light generated by $(R_v, G_v, B_v)$ is linearly related to the $R_v$, $G_v$, and $B_v$ values. That is, the intensity of light generated $(R_v, G_v, B_v)$ is one half the intensity generated by $(2R_v, 2G_v, 2B_v)$, and the two light outputs have the same spectral shape. The range over which the intensity is a linear function of the average driving current is greater in the case of pulse modulated LEDs than in LEDs in which the magnitude of the driving current is adjusted.

In the embodiment shown in FIG. 2, each of the control circuits generates values corresponding to currents that are to be applied to the three LED arrays. When an input color value $(R_v, G_v, B_v)$ is applied to the control circuits, the values generated by control circuit 108 are $R_v w_{1,j}$ for j=1 to 3. Similarly, the values generated by control circuits 109 and 110 are $G_v w_{2,j}$ for j=1 to 3 and $B_v w_{3,j}$ for j=1 to 3, respectively. The current that is applied to LED array 101 in response to this input triplet is $R_v w_{1,1}+G_v W_{2,1}+B_v W_{3,1}$. Similarly, the currents that are applied to LED arrays 102 and 103 are $R_v w_{1,2}+G_v W_{2,2}+B_v w_{3,2}$ and $R_v w_{1,3}+G_v w_{2,3}+B_v w_{3,3}$, respectively.

In the embodiment shown in FIG. 2, interface 120 is constructed from control circuits 108–110 and a drive current circuit 107. Drive current circuit 107 sums the contributions provided by each of the control circuits to generate a signal that is applied to the drivers of each of the LED arrays and sets the actual current that is to flow through each of the LED arrays.

In one embodiment of the present invention, the standardized inputs correspond to the CIE standard color scheme. The weight values for each of the control circuits are determined by adjusting the weights such that the output light conforms to the corresponding CIE color coordinate. Hence, to find the weights for the red control circuit, a triplet of (1,0,0) is applied to the light source inputs. The light generated by the light source is viewed by a spectrometer that is calibrated in the CIE color coordinate scheme. The weight values are then adjusted such that the light generated by the light source corresponds to a CIE color value of $(X_{Rv}, Y_{Rv}, Z_{Rv})$, where $(X_{Rv}, Y_{Rv}, Z_{Rv})$ is termed the 'virtual' red LED color coordinate and is some predetermined value that depends on the spectrometer. Next, the weights corresponding to the green control circuit are obtained in an analogous manner using an input triplet of the form (0,1,0) and adjusting the weights such that the camera outputs the value $(X_{Gv}, Y_{Gv}, Z_{Gv})$, the 'virtual' green LED color coordinate.

Finally, the weights corresponding to the blue control circuit are generated in an analogous manner to provide an output of ($X_{Bv}$, $Y_{Bv}$, $Z_{Bv}$), the blue 'virtual' LED color coordinate, when (0,0,1) is input to the control circuits. Search algorithms for determining the weight values are known to the art, and hence, will not be discussed in detail here. The 'virtual' LEDs function provides an ideal light source in the sense that every such ideal light source will produce the same CIE color coordinate when presented with the same input triplet.

In one embodiment of the present invention, each of the control circuits has a port for receiving the weight values that are to be used by that control circuit. Exemplary weight input ports are shown at 121–123. Each of the control circuits includes a non-volatile memory for storing the weight values received on the weight input port associated with that control circuit.

The above-described embodiments utilize a 3 color standardized color representation scheme. However, embodiments of the present invention that utilize other color representation schemes can also be constructed. For example, color coordinate systems that utilize 4 colors are well known in the printing arts. In an embodiment of the present invention based on such a coordinate system, a four component color vector would be input to the interface circuit. The interface circuit would then generate the four currents needed to specify the outputs of each of the 4 light generators. In one such embodiment, each light generator would nominally generate light of a wavelength corresponding to one of the components in the coordinate system in question. The calibration parameters would be chosen such that the output of the light source when viewed on a spectrometer that provides an output in the four color coordinate system matches the four component color vector that was input to the light source.

Figure 3:
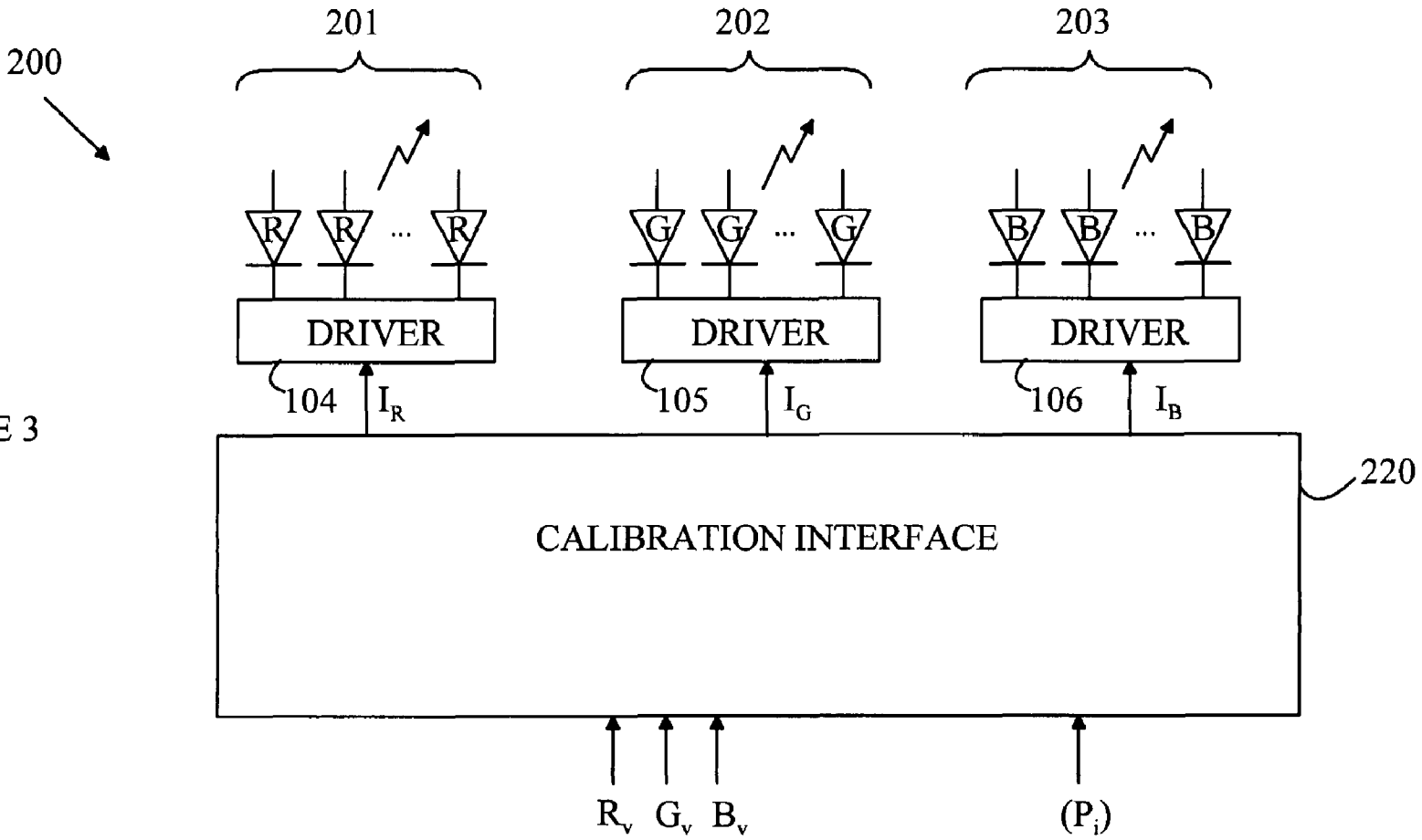
FIG. 3 is another embodiment of the present invention that utilizes a different number of weight functions.

The above-described embodiments utilize a 9-parameter weight system for calibrating the light source. In the embodiment shown in FIG. 2, the interface is divided into the control circuits and the drive current circuit. Refer now to FIG. 3, which illustrates another embodiment of the present invention that utilizes a more general interface circuit. Light source 200 includes three LED arrays 201–203 that are driven from a calibration interface circuit 220 that receives the virtual color values ($R_v$, $G_v$, $B_v$) that determine the output of the light source. Interface circuit 220 stores a plurality of calibration parameters, $P_i$, for i=1 to $N_p$.

The minimum number of parameters needed by the interface circuit in the general case can be shown to be 9 for a three color component system. The interface circuit can be viewed as a circuit that provides a simple change in coordinates between the virtual color coordinate ($R_v$, $G_v$, $B_v$) input to the present invention and a coordinate system ($I_R$, $I_G$, $I_B$) in which $I_R$, $I_G$, and $I_B$ are the average currents flowing in the red, green, and blue arrays. Such a change in coordinates can be accomplished by a matrix multiplication in which the vector ($R_v$, $G_v$, $B_v$) is multiplied by a 3×3 matrix to generate the vector ($I_R$, $I_G$, $I_B$). Since the 3×3 matrix contains 9 parameters, the general transformation can be carried out with 9 weight parameters in a 3 component color system. The above procedure provides a method for determining the weight parameters. However, the weight values can also be calculated from 9 independent measurements of the relationship between ($I_R$, $I_G$, $I_B$) and the (R, G, B) color values measured by the CIE spectrometer when these current values are applied to the LED arrays. In the more general case in which an N color system is utilized, $N^2$ weights must be determined. The weights are the coefficients in an N×N matrix that is utilized to convert the virtual color coordinate measurement into the correct drive N drive currents.

The above-described embodiments of the present invention have utilized three light generators in which each light generator comprises an array of LEDs. However, embodiments in which other forms of light generators are utilized can also be constructed. For example, the light generators can be constructed from semiconducting lasers.

Various modifications to the present invention will become apparent to those skilled in the art from the foregoing description and accompanying drawings. Accordingly, the present invention is to be limited solely by the scope of the following claims.

What is claimed is:

1. A light source comprising:

N light generators, each light generator emitting light of a different wavelength, the intensity of light generated by the $k^{th}$ generator being determined by a signal $I_k$ coupled to that light generator;

a receiver for receiving a color coordinate comprising N color components, $C_k$, for k=1 to N, wherein N is greater than 1; and an interface circuit for generating $I_k$ for k=1 to N from said received color components and a plurality of calibration parameters, said calibration parameters depending on manufacturing variations in said light generators and having values such that a light signal generated by combining said light emitted from each of said light generators is less dependent on said manufacturing variations in said light generators than a light signal generated when $I_k$ is proportional to $C_k$ for k=1 to N.

2. The light source of claim 1 wherein one of said $I_k$ is proportional to a weighted sum of said $C_k$ values, said weighted sum utilizing weight parameters that depend on said calibration parameters.

3. The light source of claim 1 wherein each of said light generators comprises an LED.

4. The light source of claim 1 wherein each of said light generators comprises a laser.

5. A light source comprising:

N light generators, each light generator emitting light of a different wavelength, the intensity of light generated by the $K^{th}$ generator being determined by a signal $I_k$ coupled to that light generator;

a receiver for receiving a color coordinate comprising N color components, $C_k$, for k=1 to N, wherein N is greater than 1; and an interface circuit for generating $I_k$ for k=1 to N from said received color components and a plurality of calibration parameters, said calibration parameters depending on manufacturing variations in said light generators and having values such that a light signal generated by combining said light emitted from each of said light generators is less dependent on said manufacturing variations in said light generators than a light signal generated when $I_k$ is proportional to $C_k$ for k=1 to N; and wherein N=3 and wherein one of said light generators generates light in the red region of the optical spectrum, another of said light generators generates light in the blue region of the optical spectrum, and the remaining light generator generates tight in the green region of the light spectrum.

6. The light source of claim 5 wherein said color components correspond to the CIE color standard and wherein said calibration parameters are chosen such that said light signal generated by combining said light emitted from each of said light generators is characterized by color components in said CIE color standard of $C'_k$ when received color components have values in which $C_k=C'_k$, for k=1 to 3.

7. A method for generating light in response to a color coordinate comprising N color components, $C_k$, for k=1 to N, wherein N is greater than 1, said method comprising:

generating $I_k$, for k=1 to N from said received color components and a plurality of calibration parameters;

generating N light components with N light generators, the $i^{th}$ light component having an intensity determined by $I_k$ and a wavelength that is different from the other light components, wherein said calibration parameters depend on manufacturing variations in said light generators and have values such that a light signal generated by combining said light emitted from each of said light generators is less dependent on said manufacturing variations in said light generators than a light signal generated when $I_k$ is proportional to $C_k$ for k=1 to N; and combining said N light components to form said generated light.

8. The method of claim 7 wherein one of said $I_k$ is proportional to a weighted sum of said $C_k$ values, said weighted sum utilizing weight parameters that depend on said calibration parameters.

9. The method of claim 7 wherein each of said light generators comprises an LED.

10. The method of claim 7 wherein each of said light generators comprises a laser.

11. A method for generating light in response to a color coordinate comprising N color components, $C_k$, for k=1 to N, wherein N is greater than 1, said method comprising:

generating $I_k$ for k=1 to N from said received color components and a plurality of calibration parameters;

generating N light components with N light generators, the $i^{th}$ light component having an intensity determined by $I_k$ and a wavelength that is different from the other light components, wherein said calibration parameters depend on manufacturing variations in said light generators and have values such that a light signal generated by combining said light emitted from each of said light generators is less dependent on said manufacturing variations in said light generators than a light signal generated when $I_k$ is proportional to $C_k$ for K=1 to N; and combining said N light components to form said generated light; and wherein N=3 and wherein one of said light generators generates light in the red region of the optical spectrum, another of said light generators generates light In the blue region of the optical spectrum, and the remaining light generator generates light in the green region of the light spectrum.

12. The method of claim 11 wherein said color components correspond to the CIE color standard and wherein said calibration parameters are chosen such that said light signal generated by combining said light emitted from each of said light generators is characterized by color components in said CIE color standard of $C'_k$ when received color components have values in which $C_k=C'_k$, for k=1 to 3.

* * * * *